US011993941B2

(12) United States Patent
Paganelli et al.

(10) Patent No.: US 11,993,941 B2
(45) Date of Patent: May 28, 2024

(54) COVERING ELEMENT FOR FLOOR AND A FLOOR COVERING

(71) Applicant: FLOORING INDUSTRIES LIMITED, SARL, Bertrange (LU)

(72) Inventors: Mariano Paganelli, Modena (IT); Claudio Beneventi, Sassuolo (IT); Lorenzo Valeriani, Scandiano (IT)

(73) Assignee: UNILIN BV, Wielsbeke (BE)

( * ) Notice: Subject to any disclaimer, the term of this patent is extended or adjusted under 35 U.S.C. 154(b) by 34 days.

(21) Appl. No.: 17/635,087

(22) PCT Filed: Aug. 19, 2020

(86) PCT No.: PCT/IB2020/057788
§ 371 (c)(1),
(2) Date: Feb. 14, 2022

(87) PCT Pub. No.: WO2021/038386
PCT Pub. Date: Mar. 4, 2021

(65) Prior Publication Data

US 2022/0290445 A1 Sep. 15, 2022

(30) Foreign Application Priority Data

Aug. 29, 2019 (IT) ..... 102019000015117

(51) Int. Cl.
*E04F 15/08* (2006.01)
*E04F 15/02* (2006.01)
(Continued)

(52) U.S. Cl.
CPC ..... *E04F 15/082* (2013.01); *E04F 15/02* (2013.01); *E04F 15/02033* (2013.01);
(Continued)

(58) Field of Classification Search
CPC ..... E04F 15/082; E04F 15/02033; E04F 15/0215; E04F 15/06; E04F 15/203;
(Continued)

(56) References Cited

U.S. PATENT DOCUMENTS 2,850,890 A * 9/1958 Rubenstein ..... B28B 11/04 264/261
3,594,969 A * 7/1971 Kantorowicz ..... E04F 13/0892 52/471
(Continued)

FOREIGN PATENT DOCUMENTS

CN 102287038 A 12/2011
DE 202007007372 U1 8/2007
(Continued)

OTHER PUBLICATIONS

Search Report and Written Opinion from corresponding Italian Application No. 102019000015117, dated May 5, 2020.
(Continued)

*Primary Examiner* — Brent W Herring
(74) *Attorney, Agent, or Firm* — Workman Nydegger

(57) ABSTRACT

A covering element for floors includes a tile made of ceramic material and a reinforcing element attached to the tile. The covering element has a lining along an edge of the tile.

7 Claims, 3 Drawing Sheets

(51) Int. Cl.
*E04F 15/06* (2006.01)
*E04F 15/20* (2006.01)

(52) U.S. Cl.
CPC ..... *E04F 15/0215* (2013.01); *E04F 15/06* (2013.01); *E04F 15/203* (2013.01); *E04F 2290/041* (2013.01)

(58) Field of Classification Search
CPC ..... E04F 2290/041; E04F 2201/049; E04F 15/02038; E04F 15/02; E04F 15/18; E04F 2290/04
USPC ..... 52/384, 385, 403.1, 387, 474
See application file for complete search history.

(56) References Cited

U.S. PATENT DOCUMENTS 3,817,012 A * 6/1974 Wack ..... E04F 19/06 428/49
4,441,301 A * 4/1984 Benson ..... E06B 3/827 49/490.1
4,546,024 A * 10/1985 Brown ..... E04F 15/02016 428/44
4,681,786 A * 7/1987 Brown ..... E04F 15/08 428/44
4,698,249 A * 10/1987 Brown ..... E04F 15/186 428/44
5,115,621 A * 5/1992 Kobayashi ..... E04F 15/02441 52/630
5,271,200 A * 12/1993 Witt ..... G09F 19/22 52/391
5,515,659 A * 5/1996 MacDonald ..... E04C 2/384 52/247
7,487,622 B2 * 2/2009 Wang ..... E04F 13/0862 52/592.1
7,610,731 B1 * 11/2009 Collison ..... E04F 15/02194 428/492
8,186,116 B2 * 5/2012 Anderson ..... E01C 5/001 52/592.1
8,539,727 B2 * 9/2013 Lui ..... E04F 15/02 52/384
8,557,083 B2 * 10/2013 Paganelli ..... E04F 13/142 52/223.6
9,771,722 B2 * 9/2017 Hurson ..... B32B 37/1027
11,505,950 B2 * 11/2022 Su ..... E04F 15/107
2009/0282760 A1 * 11/2009 Sampson ..... E04F 15/02423 52/794.1
2010/0257801 A1 * 10/2010 Anderson ..... E04F 15/087 52/391
2011/0113713 A1 * 5/2011 Lui ..... E04F 15/02 52/391
2011/0183101 A1 * 7/2011 Voith ..... E04F 15/02016 428/53
2012/0043852 A1 * 2/2012 King ..... E04F 15/02 52/173.1
2014/0144092 A1 * 5/2014 Benz ..... E04F 15/082 52/384
2015/0284965 A1 * 10/2015 Hurson ..... B32B 37/24 156/60
2015/0308127 A1 * 10/2015 Rapp ..... E04F 15/08 52/403.1
2016/0288447 A1 * 10/2016 Cordeiro ..... B32B 9/047
2021/0164238 A1 * 6/2021 Kuritz ..... B32B 27/365
2022/0251852 A1 * 8/2022 Ravis ..... E04F 13/0873
2023/0134496 A1 * 5/2023 Della Pepa ..... E04F 15/02144 52/403.1

FOREIGN PATENT DOCUMENTS

EP 2042667 A2 4/2009
WO 2007099572 A2 9/2007
WO 2010072704 A1 7/2010
WO 2019142041 A1 7/2019

OTHER PUBLICATIONS

International Search Report and Written Opinion from PCT Application No. PCT/IB2020/057788, dated Dec. 2, 2020.

* cited by examiner

COVERING ELEMENT FOR FLOOR AND A FLOOR COVERING

TECHNICAL FIELD

The present invention relates to a covering element for floors, preferably comprising a hard and/or fragile element, for example a ceramic tile. The present invention also relates to a floor covering.

In particular, the present invention relates to covering elements for floors that can be installed in a floating manner, that is to say without being fixed to the screed or sub-base.

PRIOR ART

Covering elements of hard and/or fragile material, such as ceramic tiles, are conventionally fixed to the screed by means of a mortar, usually a cement mortar. Additionally, in order to ensure that the covering is waterproof, a grout is used to fill the grout gap, that is to say the space between tiles. Installation is therefore labor-intensive and costly, since it requires specialist manpower and long setting times for the mortar. It is also extremely difficult to remove the covering, because the floor has to be demolished. Demolition also results in the destruction of the covering elements themselves.

Floating laying is a laying system that does not involve any attachment between the covering element and the screed, and it is used to speed up and simplify the laying of covering elements. This system is widely used for wood, laminate or parquet covering elements. For laying covering elements of fragile material such as ceramic tiles by floating laying, it is necessary to use a reinforcing element to increase the toughness of the tile. This is because the covering element is not fixed to the screed, and therefore the toughness of the tile itself is not sufficient to withstand even minor impacts. WO 2010/072704 describes a method for reinforcing ceramic tiles for floating laying. However, although WO 2010/072704 suggests how to reinforce tiles for floating laying, it does not suggest how to lay them. It also appears that the tiles described in WO 2010/072704 have to be grouted, and therefore, if the covering is removed, the tile may not be reusable; furthermore, the grout usually becomes attached to the screed or other laying sub-base, requiring complicated and costly operations for restoring the screed before laying the subsequent floor.

The present invention proposes, in the first place, to provide an alternative covering element for floors, and an innovative floor covering, which, according to some of its embodiments, is intended to resolve one or more of the problems arising from the prior art.

DISCLOSURE OF THE INVENTION

Consequently, the present invention, according to a first independent aspect thereof, relates to a covering element for floors comprising a tile of ceramic material and a reinforcing element joined to the tile, with the characteristic of comprising a lining of at least one edge of the tile. As a result of this solution, the covering elements may be laid in a floating installation and may also be placed in direct contact with one another so that there is no need to use any grout. Consequently, the covering elements may be easily laid and removed just as easily, without being subjected to any damage, so that they can be re-used. Indeed, the lining protects the edges of the tiles so that they can touch one another without the risk of chipping.

Preferably, the lining could be provided on a plurality of edges of the tile, for example on at least two successive edges. Thus, by positioning the covering elements in the correct orientation, the linings are sufficient to protect all the edges of the tiles, yielding savings in the material for the lining and reducing the thickness of the grout. In a preferred embodiment of the invention, however, the lining may be provided on all the edges of the tile, thereby simplifying the laying operation because there is no need to conform to a specific orientation. According to one embodiment, the lining may be provided on said plurality of edges in the form of separate elements, or in the form of a single element bent back onto a plurality of edges. In the second case, the lining is provided in a form that provides an aesthetically pleasing effect of continuity and that may also contribute to the sealing of the joint. In the first case, however, it is certainly operationally simpler apply a number of separate elements, which may also have different characteristics.

According to one embodiment of the invention, the lining may be made of polymeric material, preferably thermoplastic. For example, the lining may be made of PVC, ABS or PE. The lining may be made of rigid or compressible material; for example, the lining may be made of elastomeric material.

The lining may have a thickness of less than 1.5 mm, or preferably less than 1 mm, for example 0.6 mm. This is because a thin lining not only contains the cost of the material but also enables the thickness of the joint between the covering elements to be reduced, thus improving the overall appearance of the floor. The lining may also be capable of covering only part of the thickness of the tile, for example at least half or preferably at least two thirds of said thickness, or may be capable of covering the whole thickness of the tile.

Preferably, the lining has a color capable of imitating, or preferably identical to, the color of the upper surface and/or of a body of the tile.

The lining may be applied to the respective edge by any lining method; for example, the lining may be glued to the edge or may be extruded directly onto the edge of the tile.

Depending on the preferred embodiment, the tile is made of ceramic material, for example porcelain (also called porcelaneous stoneware), red body (single fired), clinker or monoporosa (also called single fired wall tile). However, according to alternative embodiments, the tile may be formed from any other fragile and/or hard material, for example natural stone, cement, glass or glass-ceramic.

The tile of ceramic material may preferably comprise a body of ceramic material and an upper decorative surface that can be placed facing upward in use. Said upper surface may have at least one covering layer, for example a glaze, an engobe, a glazed engobe and/or a grog. The upper surface may have a pattern, for example a solid color or a design or graphic, which is, for example, printed, preferably by digital printing. According to a preferred embodiment of the invention, the body of the tile has a color which is similar, or preferably identical, to that of the pattern, for example with the same color as the glaze.

The tile further comprises a lower surface capable of being turned toward the screed or sub-base of the floor in use. According to a preferred embodiment, the lower surface is substantially smooth, for example being free of structures such as relief elements and/or incisions. This is because the inventors have observed that the reinforcing element has a more marked effect when associated with a lower surface of the tile that is substantially smooth. Said structure of the lower surface of the tile is also known as the "mark" and is commonly used to limit the material for forming the body of the tile. In this case, we speak of a "resource saving" mark and it is distinguished from other types of mark by the thickness of the structure which may be beyond a millimeter in thickness. Therefore, according to another embodiment, the lower surface of the tile may comprise a structure having relief elements and/or incisions with a thickness of less than 1 mm, preferably less than 0.5 mm, or even more preferably less than 0.2 mm.

The tile may have a thickness of between 5 and 30 mm, preferably between 5 and 10 mm.

According to a preferred embodiment, the tile comprises at least one edge having a lower bevel. Thus, when in use, the covering elements may be installed in direct contact with one another, and the edges are not in contact over the whole thickness of the tile but only over a limited portion, so as to reduce the friction during the removal of a covering element, thus simplifying the uninstallation of the floor. The lower bevel also enables the point of contact between the edges of the tiles to be kept at a position near the upper surfaces of the tiles, so as to provide an effect of substantial continuity on the surface of the floor. In practice, "lower bevel" is taken to mean that the tile has a cross section that tapers toward the lower surface. In other words, said edge has a lower portion (that is to say, said lower bevel) which is inclined, in use, at an acute angle to the horizontal. For example, the lower bevel may form an angle with the horizontal which is preferably less than 90°, or preferably less than 85°, for example between 60° and 85°. According to a preferred embodiment of the invention, the lower bevel may preferably occupy a lower portion of said edge, for example at least a third, or preferably at least a half, for example two thirds of the thickness of the tile. Preferably, the lower bevel may be on a plurality of edges of the tile, for example on at least two successive edges, or even more preferably on all the edges of the tile.

According to a preferred embodiment, the tile further comprises an edge having an upper bevel. Thus, when in use, the covering elements may be installed in direct contact with one another, and the edges are not in contact over the whole thickness of the tile but only over a limited portion, so as to reduce the friction during the removal of a covering element, thus simplifying the uninstallation of the floor. Moreover, the upper bevel makes it possible to conceal any differences in level or differences in height among the tiles. In the conventional installation, these differences in level are concealed or masked by the grout, and, as a general rule, the wider the grout, the easier it is to conceal the difference in level. The upper bevel therefore enables the tiles to be placed together in contact while concealing the difference in level that would otherwise be emphasized by the direct contact between the tiles. In practice, "upper bevel" is taken to mean that the tile has a cross section that tapers toward the upper surface. In particular, at least an upper portion of said cross section is tapered toward the upper surface. In other words, said edge has an upper portion (that is to say, said upper bevel) which, in use, is inclined relative to the vertical. For example, the upper bevel may form an angle with the vertical which is preferably less than 90°, preferably less than 45°, or even more preferably less than 30°. According to a preferred embodiment of the invention, the upper bevel may preferably occupy an upper portion of said edge, for example less than two thirds, or preferably less than a half, for example one third of the thickness of the tile. Preferably, the upper bevel may be on a plurality of edges of the tile, for example on at least two successive edges, or even more preferably on all the edges of the tile.

According to the preferred embodiment, the lining is provided on at least one of the lower bevel and the upper bevel, preferably the lower bevel.

The reinforcing element is configured to improve the mechanical strength of the tile; in particular, it is configured to increase the toughness of the of the tile. Preferably, the reinforcing element is associated with, for example fixed, or preferably glued, to the lower surface of the tile. Preferably, the reinforcing element is fixed to the lower face of the tile by means of an adhesive, preferably a thermosetting resin, for example an epoxy, polyurethane, acrylic and/or hotmelt glue. If glues are used for fixing the reinforcing element to the tile surface, it is preferable for the lower surface of the tile to be substantially smooth or to have a structure with relief elements and/or incisions as described above. If the lower surface comprises said structure of relief elements and/or incisions, the structure may preferably comprise relief elements and/or incisions arranged in the form of lines and/or rows, for example substantially parallel to one another. This is because such structures make it possible to contain the glue and prevent it from overflowing over the edges of the tile and/or of the reinforcing element during gluing.

The reinforcing element may be made according to various options, of which three preferred options are described below.

According to a first option, the reinforcing element comprises a metal sheet, made for example of steel, preferably galvanized or stainless steel. Preferably, the metal sheet is configured to generate a compressive state in the tile, starting from the lower surface of the tile. Thus, as the tile is in a compressive state, a significant improvement in the impact resistance is obtained, since the compressive state impedes crack propagation. To achieve this objective, the metal sheet is initially put under tension (stretched or elongated) by means of mechanical or thermal stretching, and is then placed under the tile while it is still in the elongated state. The stretching is then released, by interrupting the mechanical stressing or cooling the metal sheet, so as to put the tile under compression.

According to a preferred embodiment, the metal sheet has a coefficient of thermal expansion that is greater than the coefficient of thermal expansion of the tile. As a result of this solution, the metal sheet can be stretched by heating so as to expand in a substantially uniform manner in all directions. After the sheet is placed under the tile, it may be cooled so as to contract and put the tile under compression.

Preferably, the metal sheet has a Young's modulus that is greater than the Young's modulus of the tile, being for example two or three times the Young's modulus of the tile. Thus, when the elongated state of the metal sheet is released, the sheet can effectively put the tile under compression. For example, said sheet is applied according to the method described in the international application WO 2010/072704, which is incorporated herein by reference.

In a preferred embodiment, the metal sheet has a thickness of between 0.05 mm and 1 mm, preferably between 0.05 mm and 0.5 mm, or even more preferably between 0.1 and 0.2 mm, for example 0.12 mm. It should be noted that thicknesses of the sheet between 0.1 and 0.2 mm are preferably used for tiles having a thickness of less than 15 mm, while for tiles having a thickness of more than 15 mm it is preferable to use a sheet having a thickness of between 0.2 and 0.4 mm.

Additionally, the reinforcing element may comprise one or more protective coverings, each capable of covering the metal sheet at least partially, or preferably totally, so as to protect it from corrosion. Thus the covering element is made suitable for use outside and/or in wet environments. According to a preferred embodiment, the protective covering may comprise an enamel, a varnish or a sheath. Preferably, the reinforcing element comprises a metal sheet of the PPGI (Pre-Painted Galvanized Iron) or PPGL (Pre-Painted GalvaLume) type. This symbol denotes sheets of metal (not necessarily steel) that are galvanized (or covered with a layer of zinc or aluminum) and varnished. In practice, the metal sheet is covered on only one or both surfaces with a first layer of zinc, possibly a layer of chromium plating, and one or more layers of varnish or sheaths, made for example of polymeric material, namely epoxy resin, polyurethanes, polyvinyls, polyolefins, or, preferably, polyesters.

The reinforcing element may also comprise on at least one of its surfaces a primer for promoting adhesion to the tile, preferably to the lower surface of the tile.

The metal sheet may advantageously have ferromagnetic and/or paramagnetic characteristics, preferably ferromagnetic, so as to be attracted by suitable connecting means associated with the screed, which in this case are magnetic. Thus the sheet can both meet the requirements for toughness of the tile and contribute actively to fixing the tile to the screed, without any need for applying further substances to, or performing other operations on, the tile itself.

According to a second embodiment option for the reinforcing element, the latter may comprise a layer of glass fiber, for example a glass fiber textile, mesh or mat. The glass fiber may be woven or nonwoven. The reinforcing element may comprise glass fibers arranged in a number of planes, for example with a different orientation in each plane. Alternatively, or in combination with the glass fiber, it is possible to use carbon fibers, polymeric fibers such as aramid or polyamide fibers, or ceramic fibers such as boron or silicate fibers. The inventors have found that the fiber reinforcing element enables the rigidity of the covering element to be improved so as to impede crack propagation and thus improve bending resistance.

According to one embodiment, the reinforcing element may comprise a rigid element and a glass fiber layer, in such a way that the glass fiber layer is placed between the tile and the rigid element. Preferably, the rigid element is made of fragile material, for example natural stone, cement, ceramic, glass or glass-ceramic. In particular, the rigid element is substantially made of the same material as the tile. For example, the rigid element may be formed by a ceramic tile, made for example of porcelain, preferably of lower quality than the tile; for example, it may be formed by recycled or undecorated material. The rigid element may have the same thickness as the tile, although there is no reason why the rigid element should not have a greater or smaller thickness than the tile. In any case, covering elements that comprise a reinforcing element having a rigid element advantageously comprise a ceramic tile having a thickness of less than 12 mm, for example 10 mm or less.

According to a third option for the embodiment of the invention, the reinforcing element comprises a resin, thermoplastic or thermosetting, capable of permeating open pores of the tile. Preferably, said resin has a viscosity of less than 1000 mPas at 20° C. in a non-set state, for example between 600 and 200 mPas. Because of this very low viscosity, the resin during the application can permeate said open pores so as to create a kind of composite resin-ceramic material in the proximity of the lower surface of the tile. Preferably, said resin is a rigid resin, for example an epoxy resin. Additionally, according to said third option, said resin may act as a glue between the tile and a supporting element. Said supporting element is preferably made of plastic material, preferably thermoplastic. For example, said supporting element is made of PVC, preferably rigid PVC. In particular, according to this third option for forming the reinforcing element, the latter and the supporting element may be formed as described in U.S. patent application Ser. No. 16/278,560, which is incorporated herein by reference.

Preferably, the reinforcing element has substantially the same horizontal shape and/or size (in plan view) as the tile. Additionally, the tile and the reinforcing element are superimposed so that, in use, the reinforcing element is substantially concealed by the tile. According to the preferred embodiment, the reinforcing element has a slightly smaller horizontal size (in plan view) than that of the lower surface of the tile, for example in such a way that the edges of the reinforcing element do not project beyond the edges of the tile. Thus, especially if the reinforcing element comprises a metal sheet, the possibility of an operator cutting himself on the sheet is prevented.

According to the second or third option for forming the reinforcing element, the element may comprise a ferromagnetic or paramagnetic component, for example a lining including ferromagnetic particles, that can be attracted by a magnetic element associated with the screed. Alternatively, it is possible for the reinforcing element, according to each of said first, second and third options, to comprise a magnetic component, for example a magnetic film, capable of attracting a magnetic, ferromagnetic or paramagnetic component associated with the screed.

In an alternative embodiment, however, the reinforcing element may project beyond one or more edges of the tile, preferably beyond two consecutive edges of the tile. For example, according to this embodiment, the reinforcing element may be positioned off-center relative to the tile, so that one or more edges of the reinforcing element project beyond the edges of the tile and one or more edges of the tile project beyond the edges of the reinforcing element. Advantageously, the portion of reinforcing element that projects from the tile may comprise connecting means capable of creating a connection with an adjacent reinforcing element, and capable of preventing relative movements between the covering elements in a horizontal and/or vertical direction. Said connecting means may be mechanical means, for example locking means capable of forming a lock with corresponding means of an adjacent covering element, or chemical means, for example an adhesive. Preferably said connecting means may comprise an adhesive portion arranged on an upper surface of a projecting portion of the reinforcing element. Thus, in use, two covering elements may be partially superimposed so that the tile of a first covering element is located over a projecting portion of the reinforcing element of a second covering element, and is glued to the adhesive portion of the latter. The adhesive portion creates a connection that prevents relative movements between the covering elements. The adhesive portion may be covered with a film that is removable at the time of use. Preferably, the adhesive portion comprises an adhesive of the easy stick, easy remove type, for example an adhesive having a tensile strength of less than 1000 N/m, preferably less than 700 N/m, or even more preferably less than 30 N/m, for example between 80 N/m and 270 N/m. Thus the covering elements can easily be removed. The values of tensile strength given above allow the covering elements to be removed, and repositioned if necessary, very easily without the use of pullers or other professional implements.

It should be noted that the fact that the covering element comprises a portion of the reinforcing element projecting from the tile and having an adhesive portion constitutes an inventive concept independent of other characteristics of the covering element, such as the lining of the edges. Therefore, a second independent aspect of the invention provides a covering element comprising a tile of ceramic material and a lower element associated with a lower surface of the tile, in which said lower element comprises a portion that projects from an edge of the tile, and in which said projecting portion comprises at least one adhesive portion. Said covering element may comprise one or more characteristics described in relation to the first independent aspect. In particular, said lower element may comprise a reinforcing element as described above. Additionally, said tile of ceramic material may be replaced in an equivalent manner by a tile of natural stone, glass, glass-ceramic, cement, or any hard and/or fragile material.

It should be noted that the presence of the projecting portion of the lower element provides the effect of protecting the screed from any interposition of grout, preventing contact between said grout and the screed. Thus, if the floor is dismantled, the screed will be immediately re-usable without any restoration work. It should be noted that the above description concerning the screed is also valid in the case of the interposition of an underlay such as a sound-absorbing mat, interposed between the screed and the covering elements. In this case, the projecting portions will have the effect of preventing contact between the mat and the grout, making the mat completely re-usable.

A third independent aspect of the invention provides a floor covering comprising a plurality of covering elements having one or more of the characteristics described in relation to the first and/or the second independent aspect. It should be noted that "covering" denotes a system comprising the elements mentioned above and below for forming a floor covering, for example a kit comprising said elements, and not necessarily the installed covering.

Preferably, the covering comprises an underlay placed between the covering element and the sub-base to be covered.

According to the preferred embodiment, said underlay has an adhesive portion facing said covering elements. The adhesive portion creates a connection that prevents relative movements between the covering elements. The adhesive portion may be covered with a film that is removable at the time of use. Preferably, the adhesive portion comprises an adhesive of the easy stick, easy remove type, for example an adhesive having a tensile strength of less than 1000 N/m, preferably less than 700 N/m, or even more preferably less than 30 N/m, for example between 80 N/m and 270 N/m. Thus the covering elements can easily be removed. The values of tensile strength given above allow the covering elements to be removed, and repositioned if necessary, very easily without the use of pullers or other professional implements.

According to a first preferred embodiment of the invention, the adhesive portion may substantially cover the whole upper surface of the underlay, that is to say the surface that can face the covering elements. This solution is preferred, since it provides freedom in the laying and arrangement of the covering elements, as well as a choice of formats of the covering elements themselves.

According to a second embodiment of the invention, the underlay comprises a plurality of adhesive portions which are, for example, arranged in a predetermined pattern. Thus the area of adhesion between the covering element and the underlay can be reduced, so as to simplify the removal of the covering elements. Advantageously, said pattern is predetermined on the basis of the arrangement of the covering elements, and/or the format of the covering elements themselves. For example, said adhesive portions may be arranged so as to be separated from one another by a distance that is an integer multiple or submultiple of the dimension of one of the sides of the covering element, for example so as to form a lattice.

Additionally, according to alternative embodiments, there is no reason why the underlay should not have adhesive portions. In this case, the covering may comprise other means configured to prevent and/or limit movements of the covering elements. For example, said means may comprise:

- at least one double-sided adhesive component, in the form of a tape or strip for example, interposed between the covering elements and the underlay; and/or
- an adhesive portion provided on the lower surface of the covering elements, which may comprise one or more of the characteristics of the aforementioned adhesive portion of the underlay; and/or
- magnetic means associated with the underlay and configured to attract the covering element, for example a ferromagnetic element associated with the covering element, preferably the reinforcing element; or, conversely, ferromagnetic elements configured to be attracted by magnetic elements associated with the covering element, and/or
- a lining and/or a treatment of at least one of the upper surface of the underlay and the lower surface of the covering elements, configured to increase the friction between the upper surface of the underlay and the lower surface of the covering elements.

The underlay may also comprise indicators for identifying the position of the covering elements on the underlay. Thus the laying of the covering elements is simplified by providing the layer with a reference point, which may also be used for maintaining a correct alignment between the covering elements. Said indicators may be formed by means of printed designs, or may be provided in any other way on the upper surface of the underlay. For example, said indicators may be formed by coloring said plurality of adhesive portions.

Alternatively, the indicators may be represented by a relief structure. For example, according to a first embodiment option for said relief, the relief structure may comprise small crosses for defining the meeting between the corners, or angles, of the covering elements. Said relief structure may comprise walls for defining compartments for receiving the covering elements, for example by substantially defining the design of the joints. Said relief elements have a height that is equal to or preferably smaller than the thickness of the covering element. For example, in a second embodiment option for said relief, the relief forms walls for defining compartments to receive the covering elements and has a height substantially equal to or slightly less than the thickness of the covering elements, so as to substantially define said grout gap. Therefore, according to the second option, the covering elements are not in direct contact with one another, and, advantageously, the covering elements may be free of the edge lining. Preferably, in this second option, the relief may be formed from compressible material, for example elastomeric material, so as to waterproof the covering. In a third embodiment option for said relief, the relief may form walls for defining compartments to receive the covering elements and has a height that is less than the thickness of the covering elements, defining only a lower portion of the grout gap. According to the third option, the covering may comprise a grout for filling the space between the covering elements. The grout may be provided above the relief, forming an upper portion of the grout gap.

In the preferred embodiment, the underlay comprises a lower surface, that is to say a surface capable of facing the screed or sub-base, which is free of adhesive, so as to provide floating laying and easy removal of the covering. However, according to alternative embodiments, the lower surface of the underlay may comprise one or more adhesive portions. In this case, the adhesive portion of the lower surface of the underlay may preferably have a tensile strength which is different from, for example higher than, the tensile strength of the adhesive portion of the upper surface of the underlay. The underlay may also be fixed to the sub-base, or screed, by means of any fixing system such as double-sided adhesive tapes or nails.

The underlay may preferably be configured to reduce the treading noise; for example, it is a sound-absorbing mat and/or comprises a sound-absorbing layer. The underlay may preferably be configured to waterproof the sub-base and/or prevent the formation of fungus and/or mold.

Preferably, the underlay may be made of polymeric material, for example expanded polymeric material. Preferably, the underlay has a thickness of between 1 and 5 mm, for example between 2 and 4 mm.

The underlay is preferably in the form of a mat, foil or sheet. Advantageously, the underlay is flexible so that it can be easily rolled up or folded, thus reducing its dimensions for transport and storage. However, there is no reason why the underlay should not be rigid, for example in the form of panels that can be placed next to one another to form a modular underlay.

It should be noted that the fact that the underlay comprises the adhesive portion constitutes an inventive concept independent of the characteristics of the covering elements. Therefore a fourth independent aspect of the invention provides an underlay for floors comprising at least an upper surface that can face covering elements of the floor, with the characteristic that said upper surface comprises at least one adhesive portion. Said underlay may comprise one or more characteristics described in relation to the third independent aspect. In particular, the adhesive portion may be replaced by the magnetic means and/or means for modifying the friction between the underlay and the covering element.

The covering may be either of the type with a grout gap or without a grout gap; in the second case, the covering elements are in accordance with the first option for embodiment.

In the case of covering with a grout gap, it is preferable for the grout to be made of polymeric material, for example acrylic- epoxy- or silicone-based material. Additionally, advantageously, the covering may be configured to prevent adhesion between the grout and the underlay, so as to facilitate the dismantling of the covering and the re-use of its components. This solution is particularly important in the case of an underlay with magnetic elements. Magnetic underlays may have a relatively high cost, and by impeding the adhesion between the grout and the underlay it is possible to replace the covering elements without requiring the replacement of the underlay, thus reducing the costs of renewing the covering.

Adhesion between the grout and the underlay may be prevented according to one or more of the options listed below, considered either singly or in combination with one another.

According to a first option for preventing adhesion between the underlay and the grout, a physical barrier may be interposed between the grout and the underlay. Said barrier may comprise, for example, a film, a membrane or a sheet. The barrier may also comprise a thread or a tube, made of plastic for example, to be inserted into the grout gap between the edges of the covering elements before the application of the grout. The barrier may be defined by the projecting portion of the reinforcing element.

A second option for preventing adhesion between the underlay and the grout is to use a substance that chemically or physically prevents said adhesion. For example, this substance may be a releasing agent or a lubricant to be applied in the grout gap before the application of the grout; alternatively, it may be applied to the underlay in the form of a surface coating.

According to a third option for preventing adhesion between the underlay and the grout, the covering may comprise an interstice between the underlay and the grout. For example, the grout may be applied so that it is fixed to the upper portions of the edges of the covering elements without coming into contact with the underlay. In this case, it is preferable to apply the grout in the form of a paste or gel. For example, the grout may be applied in a smaller quantity than that required to occupy the volume of the grout gap between the covering elements. Advantageously, the distance between the edges of the covering elements may be less than 4 mm, or preferably less than 3 mm, for example equal to or less than 2 mm. This increases the probability that the grout will be fixed to said edges without collapsing under its own weight toward the bottom of the grout gap, that is to say toward the underlay.

It should also be noted that the fact that the underlay comprises said indicators and/or said relief structure constitutes an inventive concept independent of the characteristics of the covering elements. Therefore a fifth independent aspect of the invention provides an underlay for floors comprising at least an upper surface that can face covering elements of the floor, with the characteristic that said upper surface comprises indicators and/or a relief structure configured to facilitate the laying of said floor covering elements. Said underlay may comprise one or more characteristics described in relation to the third independent aspect.

BRIEF DESCRIPTION OF THE DRAWINGS

Further characteristics and advantages of the invention will be apparent from a perusal of the following description, provided by way of example and in a non-limiting way, with the aid of the figures shown on the attached sheets.

BEST EMBODIMENT OF THE INVENTION

Figure 1:
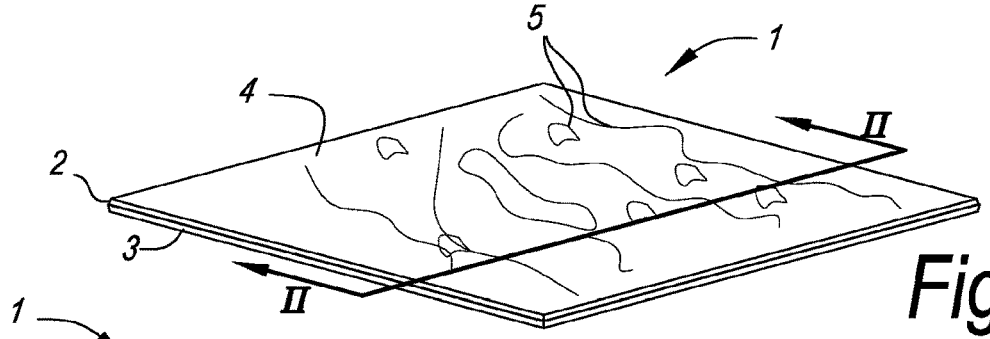
FIG. 1 shows an axonometric view of a covering element according to the invention.

FIG. 1 shows an axonometric view of a covering element 1 for floors. There is no reason why the covering element 1 should not be used for lining walls.

The covering element 1 comprises a tile 2 of ceramic material, for example porcelaneous stoneware, red body (single fired), monoporous ceramic or clinker. The tile 2 may be replaced in an equivalent manner by a tile made of hard and/or fragile material such as glass, glass-ceramic, cement, and/or natural stone.

The tile 2 has a substantially rectangular shape, square for example, and has edges 3 and a decorative upper surface 4. The upper surface 4 comprises a pattern 5 which, for example, simulates wood, natural stone or cement. Preferably, the pattern 5 is printed by digital printing.

Figure 2:
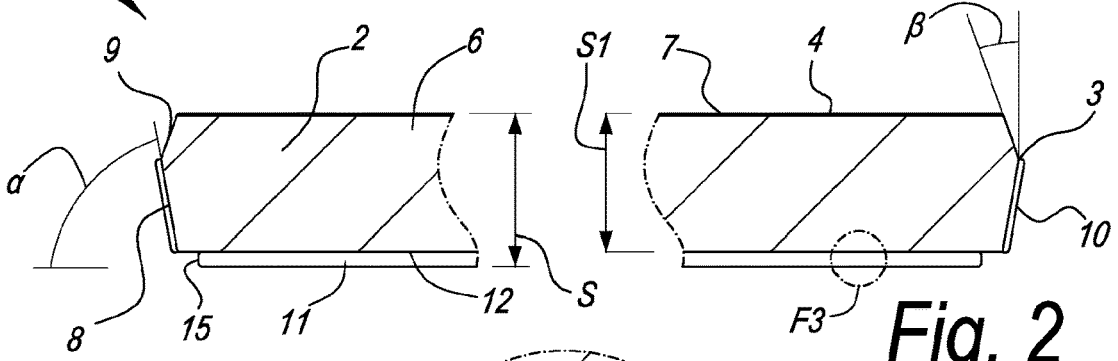
FIG. 2 shows an enlargement of the cross section taken along the plane II-II of FIG. 1.

FIG. 2 shows an enlargement of the cross section taken along the plane II-II of FIG. 1. As shown in FIG. 2, the tile 2 of the example comprises a body 6 of ceramic material and a layer 7 covering the upper surface of the body 6. For example, the covering layer comprises at least a glaze, an engobe, a glazed engobe and/or a grog. The covering layer 7 substantially defines the 1*a* upper surface 4 of the tile 2. The pattern 5 is advantageously produced in, on top of, or under the covering layer. In the preferred embodiment, the body 6 has a color which is similar, or preferably identical, to that of the pattern 5, for example with the same color as the glaze.

The tile 2 has a thickness S1 of between 5 and 30 mm, preferably between 6 and 10 mm.

In the example shown in FIG. 2, the edges 3 of the tile 2 comprise a lower bevel 8 and an upper bevel 9. In particular, the lower bevel 8 occupies a lower portion of the edge 3, for example two thirds of the thickness S1, while the upper bevel 9 occupies an upper portion del edge 3, for example one third of the thickness S1 of the tile 2. The lower bevel 8, in use, forms an angle $\alpha$ with the horizontal plane which is less than 90°, for example less than 85°. The upper bevel 9, in use, forms an angle $\beta$ with a vertical plane which is less than 90°, for example less than 90°, or preferably less than 45°.

The covering element 1 further comprises a lining 10 of the edges 3 of the tile 2. In the preferred example shown in the figure, the lining 10 is configured to cover only the lower bevel 8. Preferably, the lining 10 is made of a polymeric material, preferably thermoplastic, for example PVC, PE or ABS. For example, the lining 10 is provided in the form of a strip of polymeric material glued to the edge 3. Advantageously, the lining 10 has a color capable of imitating, or preferably identical to, the color of the upper surface 4 and/or of the body 6 of the tile 2.

The lining 10 has a thickness S2 of less than 1.5 mm, or preferably less than 1 mm, for example 0.6 mm.

As shown in FIG. 2, the covering element 1 comprises a reinforcing element 11 configured to improve the mechanical strength of the tile 2; in particular, it is configured to increase the toughness of the tile 2. Even more particularly, the reinforcing element 11 is configured to improve the impact resistance of the tile 2.

Preferably, the reinforcing element 11 is fixed to a lower surface 12 of the tile 2 by means of an adhesive, preferably a thermosetting resin, for example an epoxy, polyurethane, acrylic and/or hotmelt glue.

In the embodiment shown in FIG. 2, the reinforcing element 11 has substantially the same shape as the tile 2. In particular, the reinforcing element 11 has a slightly smaller horizontal size (in plan view) than that of the lower surface 12 of the tile 2. For example, the reinforcing element 11 has edges 15 that do not project beyond the edges 3 of the tile 2. That is to say, the edges 15 of the reinforcing element 11 are contained within the perimeter defined by the edges 3 of the tile 2.

Figure 3:
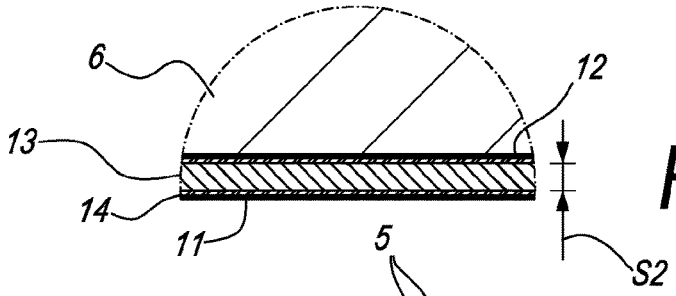
FIG. 3 shows an enlargement of the area F3 of FIG. 1.

FIGS. 2 and 3 show a preferred embodiment in which the reinforcing element 11 comprises a metal sheet 13, made for example of steel, preferably galvanized or stainless steel. Preferably, the metal sheet 13 is configured to generate a compressive state in the tile 2, particularly starting from the lower surface 12 of the tile. Thus, as the tile 2 is in a compressive state, a significant improvement in the impact resistance is obtained, since the compressive state impedes crack propagation. To achieve this objective, the metal sheet 13 is initially put under tension (stretched or elongated) by means of mechanical or thermal stretching, and is then fixed under the tile 2 while still in the elongated state. The stretching is then released, by interrupting the mechanical stressing or cooling the metal sheet 13, so as to put the tile 2 under compression.

According to the preferred embodiment, the metal sheet 13 has a coefficient of thermal expansion that is greater than the coefficient of thermal expansion of the tile 2. As a result of this solution, the metal sheet can be stretched by heating so as to expand in a substantially uniform manner in all directions. After the sheet 13 is fixed under the tile 2, it may be cooled so as to contract and put the tile 2 under compression.

Preferably, the metal sheet 2 has a Young's modulus that is greater than the Young's modulus of the tile 2, being for example two or three times the Young's modulus of the tile 2. Thus, when the elongated state of the metal sheet 13 is released, the sheet can effectively put the tile 2 under compression. For example, said sheet 13 is applied according to the method described in the international application WO 2010/072704, which is incorporated herein by reference.

In a preferred embodiment, the metal sheet 13 has a thickness S2 of between 0.05 mm and 1 mm, preferably between 0.05 mm and 0.5 mm, or even more preferably between 0.1 and 0.2 mm, for example 0.12 mm.

Advantageously, the reinforcing element 11 may comprise one or more protective coverings 14, each capable of covering the metal sheet 13 at least partially, or preferably totally, so as to protect it from corrosion. According to a preferred embodiment, the protective covering 14 may comprise an enamel, a varnish or a sheath.

The reinforcing element 11 may also comprise on at least one of its surfaces a primer for promoting adhesion to the tile 2, preferably to the lower surface of the tile. In particular, the primer is configured to promote the adhesion of the glue to the surface of the reinforcing element 11.

It should be noted that, as shown by 2 and 3, the lower surface 12 of the tile 2 is usually smooth, that is to say free of relief structures, also known as a mark. Thus the adhesion between the reinforcing element 11 and the lower surface 12 of the tile 2 is improved so as to improve the reinforcing effect of the reinforcing element 11.

Figure 4:
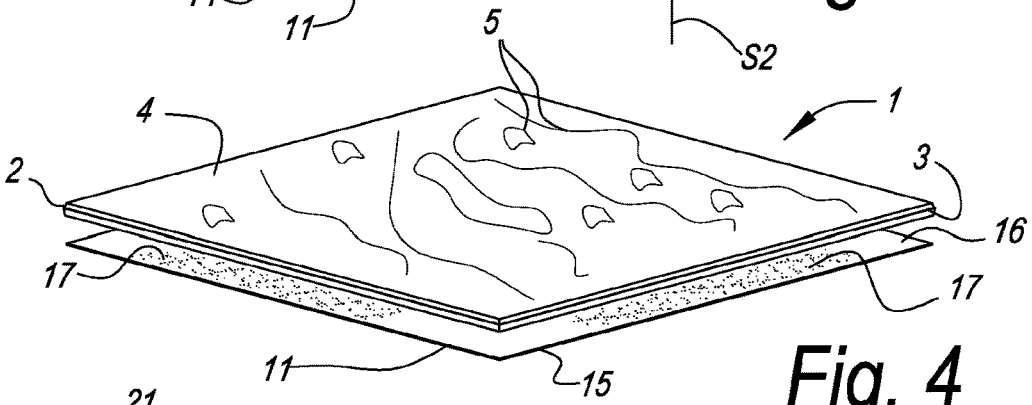
FIG. 4 shows an axonometric view of a covering element according to a particular embodiment of the invention.

FIG. 4 shows an alternative embodiment of the covering element 1 in which the reinforcing element 11 projects beyond two consecutive edges 3 of the tile 2. In particular, the reinforcing element 11 is associated in an off-center way with the tile 2. The projecting portion of the reinforcing element 11 comprises an adhesive portion 17 provided with a glue or an adhesive. The adhesive portion 17, in use, faces upward. Thus, in use, the adhesive portion may glue a portion of the lower surface 12 of an adjacent covering element 1 that is free of the reinforcing element 11, preventing relative movements between the covering elements 1. Advantageously, the adhesive portion comprises an easy stick, easy remove glue, for example one having a tensile strength of less than 1000 N/m, preferably less than 700 N/m, or even more preferably less than 30 N/m, for example between 80 N/m and 270 N/m.

Figure 5:
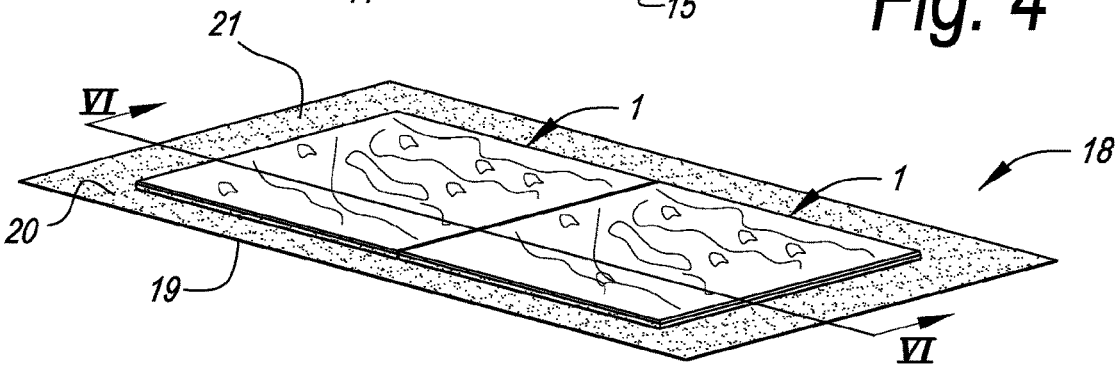
FIG. 5 shows an axonometric view of a floor covering comprising a plurality of the covering elements of FIG. 1.

FIG. 5 shows an axonometric view of a floor covering 18 comprising a plurality of the covering elements 1 as shown in FIG. 1. In the embodiment shown in FIG. 5, the covering 18 comprises an underlay 19 arranged between the covering elements 1 and the screed or sub-base.

The underlay 19 is preferably configured to reduce the treading noise; for example, it is a sound-absorbing mat. The underlay 19 is also preferably configured to waterproof the sub-base and/or prevent the formation of fungus and/or mold.

In the example, the underlay is preferably in the form of a mat, foil or sheet, and is made of a polymeric material, for example an expanded polymeric material.

In the example shown in FIG. 5, the underlay 19 comprises an upper surface 20, that is to say a surface that is capable, in use, of facing toward the covering elements 1, provided with an adhesive portion 21 which, in the example, covers substantially the whole upper surface 20. Advantageously, the adhesive portion 21 comprises an easy stick, easy remove glue having a tensile strength of less than 1000 N/m, preferably less than 700 N/m, or even more preferably less than 30 N/m, for example between 80 N/m and 270 N/m.

Figure 6:
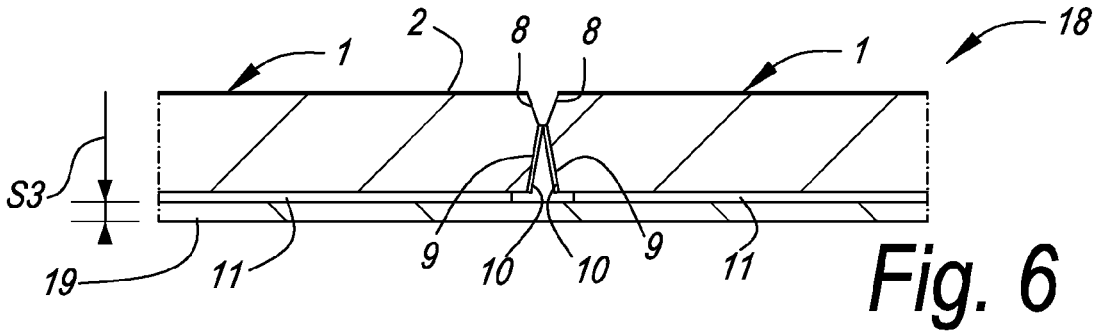
FIG. 6 shows an enlargement of the cross section taken along the plane VI-VI of FIG. 5.

FIG. 6 shows an enlargement of the cross section taken along the plane VI-VI of FIG. 5. In the embodiment shown, the covering elements 1 are arranged in direct contact with one another. In particular, the linings 10 of the edges are in contact with one another, to prevent direct contact between the ceramic tiles 2 and prevent damage to the latter.

Preferably, the underlay 19 has a thickness S3 of between 1 and 5 mm, for example between 2 and 4 mm.

Figure 7:
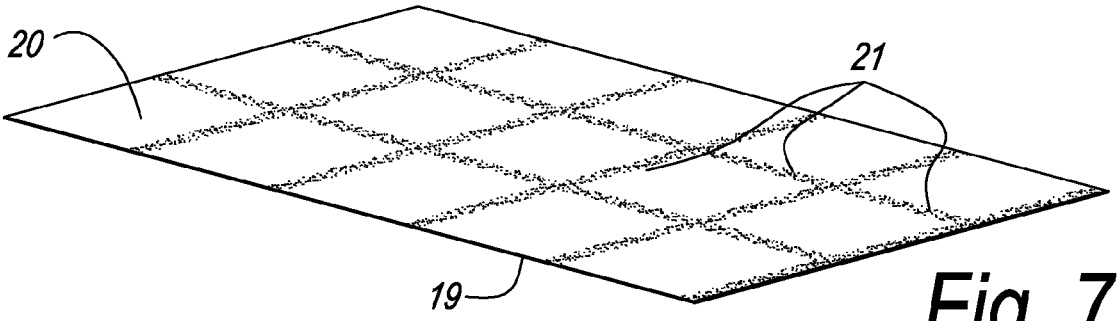
FIG. 7 shows an axonometric view of an underlay for floor coverings according to a first embodiment of the invention.

FIG. 7 shows an axonometric view of an underlay 19 according to another embodiment, in which the adhesive portion 21 does not cover the whole of the upper surface 20 of the underlay 19. In particular, in the embodiment shown, the adhesive portion 21 is arranged so as to mark out a lattice, or a plurality of adhesive portions 21 are arranged to form a lattice. Preferably, the distance between the adhesive portions 21 is a multiple or submultiple of the length of the edges 3 of the covering elements 1.

Figure 8:
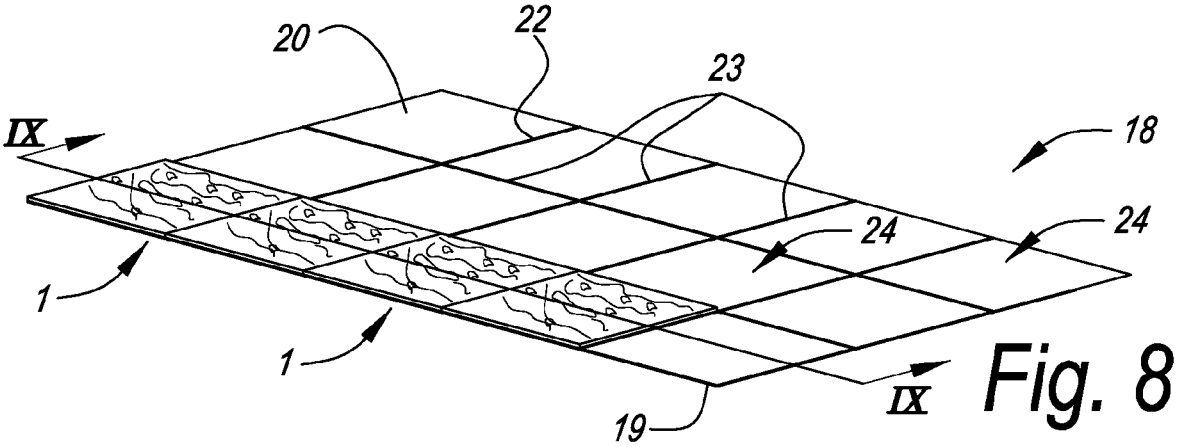
FIG. 8 shows an axonometric view of an underlay for floor coverings according to a second embodiment of the invention.

FIG. 8 shows an axonometric view of an underlay 19 according to a further embodiment. In this example, the underlay comprises a relief structure 22 comprising walls 23 for defining compartments 24 for receiving the covering elements 1, for example by substantially defining the design of grout gaps between the covering elements 1.

Figure 9:
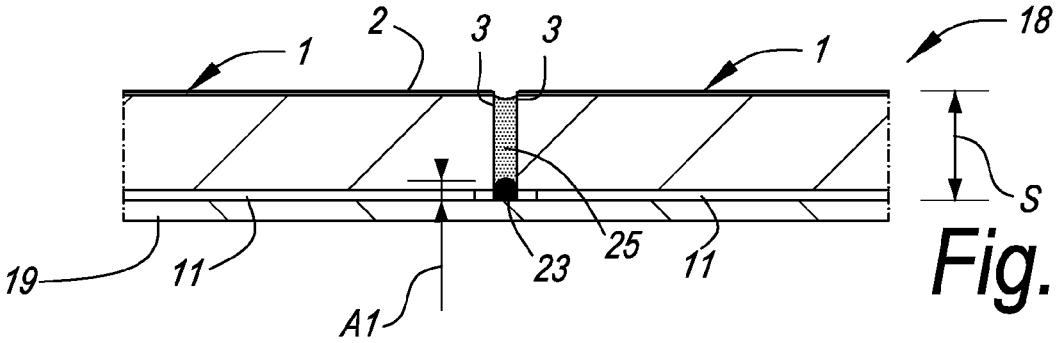
FIG. 9 shows an enlargement of the cross section taken along the plane IX-IX of FIG. 8, in a first embodiment option.

FIG. 9 shows an enlargement of the cross section taken along the plane IX-IX of FIG. 8, in a first embodiment option in which the walls 23 of the relief structure 22 have a height A1 which is less than the thickness S of the covering elements 1. In the illustrated example, the covering elements 1 are free of the lining 10. Additionally, but not necessarily, the edges 3 are substantially free of the bevels 8 and 9, or preferably free of at least the lower bevel 8. In this embodiment, the edges 3 of the covering elements 1 are in contact with the walls 23, so that the relief structure 22 prevents movements of the covering elements 1. In this embodiment, it is unnecessary to use adhesives between the covering elements and the underlay 19. The edges 3 of the covering elements are therefore spaced apart, and the space between the covering elements is occupied by a grout 25 to waterproof the covering 18.

Figure 10:
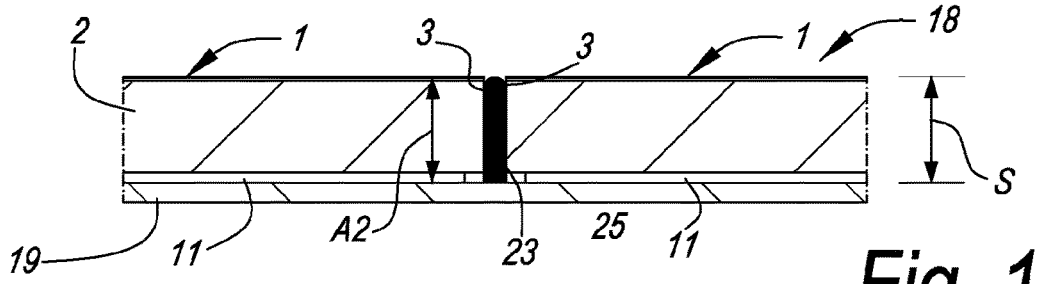
FIG. 10 shows an enlargement of the cross section taken along the plane IX-IX of FIG. 8, in a second embodiment option.

FIG. 10 shows a second embodiment option of the underlay 19 which differs from the embodiment option of FIG. 9 in that the walls 23 of the relief structure 22 have a height A2 which is substantially equal to or slightly less than the thickness S of the covering elements 1. In this embodiment option, the relief structure 22 is made of compressible material, for example an elastomeric material, so as to waterproof the covering 18.

Figure 11:
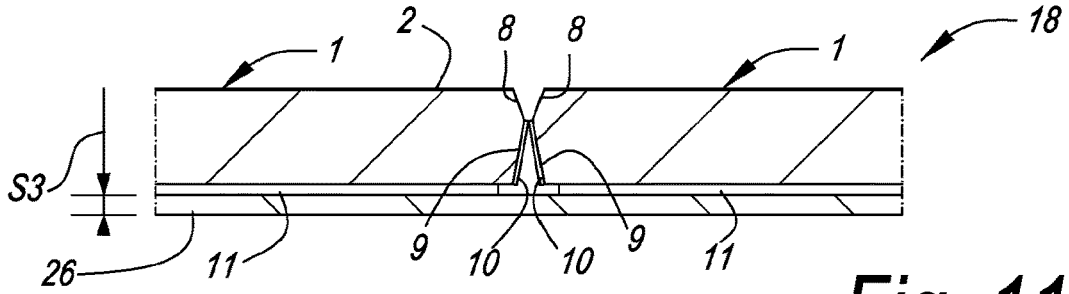
FIG. 11 shows the cross section of FIG. 6 according to an alternative embodiment.

FIG. 11 shows an alternative embodiment of the invention which differs from the embodiment shown in FIGS. 5 and 6 in that the covering 18 comprises a magnetic underlay 26. The magnetic underlay 25 is configured to magnetically attract the metal sheet 13, which in this case is preferably ferromagnetic, of the reinforcing element 11.

Figure 12:
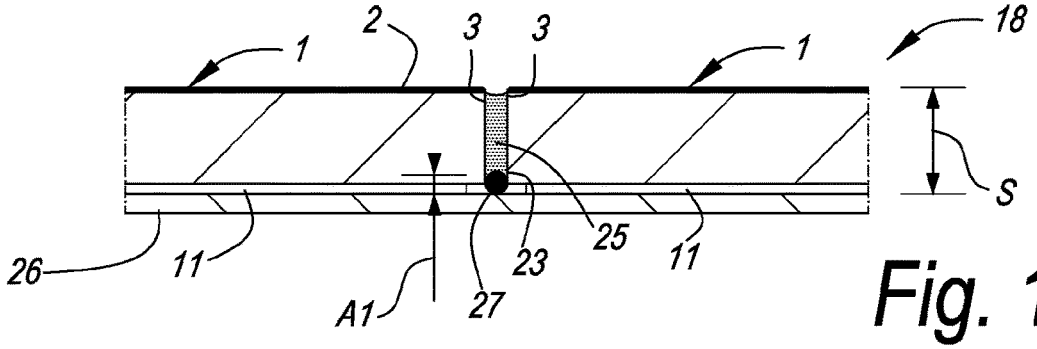
FIG. 12 shows the cross section of FIG. 11 according to a first variant embodiment.

FIG. 12 shows an alternative embodiment to that shown in FIG. 10, in which the edges 3 of the covering elements 1 are free of the lining 10, and the space between the covering elements 1 is filled by a grout 26. In the embodiment shown in FIG. 12, the covering comprises means for preventing adhesion between the grout 25 and the magnetic underlay 26. In particular, in the example, said means are represented by a physical barrier interposed between the grout 25 and the magnetic underlay 26, for example in the form of a bead 27 of polymeric material.

Figure 13:
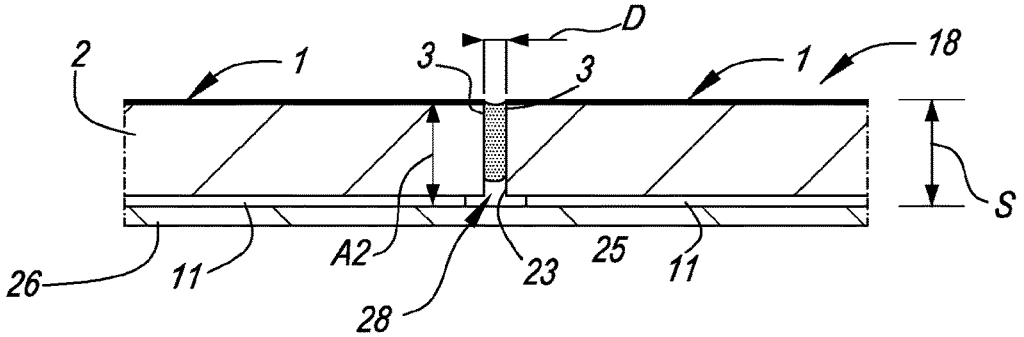
FIG. 13 shows the cross section of FIG. 11 according to a second variant embodiment.

The embodiment shown in FIG. 13 differs from that shown in FIG. 12 in that the covering is free of the physical barrier 17 and in that the grout 25 adheres to the upper portions of the walls 23 of the edges 3 of the covering elements 10, forming a gap 28 that separates it from the magnetic underlay 26. In this case, it is preferable for the grout 26 to be in the form of a paste, a gel or other high-viscosity product, for example a thixotropic fluid. Additionally, in the embodiment of FIG. 13, the edges 3 between the covering elements 1 are placed at a distance D from one another equal to 2 mm, so as to promote the adhesion of the grout 25 to the walls 23.

The invention thus conceived is susceptible of numerous modifications and variations, all of which are within the scope of the inventive concept.

Furthermore, all the details may be replaced with other technically equivalent elements. In practice, the materials used, as well as the contingent shapes and dimensions, may be any, according to requirements, without thereby departing from the protective scope of the following claims.

The invention claimed is:

1. A floor covering comprising a plurality of covering elements, wherein each covering element comprises a tile made of ceramic material and a reinforcing element of ferromagnetic material attached to the tile, and wherein the covering comprises one underlay placed between multiple covering elements and a sub-base to be covered;

wherein said one underlay is magnetic and capable of magnetically attracting said reinforcing element;

wherein the covering elements are spaced apart by a distance, the covering comprising a grout capable of occupying the distance;

wherein the covering is configured to prevent adhesion between the grout and the underlay;

wherein a gap is formed between the grout and the underlay, the gap separates the grout from the underlay to impede contact therewith.

2. The floor covering of claim 1, wherein the reinforcing element comprises a metal sheet compressing the tile.

3. The floor covering of claim 2, wherein said metal sheet has a thickness of between 0.01 and 1 mm.

4. The floor covering of claim 2, wherein said metal sheet comprises an anti-oxidation coating.

5. The floor covering of claim 2, wherein said reinforcing element is attached to a lower surface of the tile; and wherein said reinforcing element is adapted to cover said lower surface only partially.

6. The floor covering of claim 1, wherein said ceramic material is porcelain.

7. The floor covering of claim 1, wherein the tile has a thickness of between 5 and 25 mm.

* * * * *